United States Patent [19]

Cormack et al.

[11] Patent Number: 4,696,072

[45] Date of Patent: Sep. 29, 1987

[54] SPATTER GUARD FOR PAINT ROLLERS

[76] Inventors: Owen R. Cormack, 13 Leeds St., Rhodes NSW 2138; James H. Keane, 6/12 Garrick St., Coolangatta Qld 4225, both of Australia

[21] Appl. No.: 773,008

[22] PCT Filed: Dec. 5, 1984

[86] PCT No.: PCT/AU85/00250

§ 371 Date: Oct. 21, 1985

§ 102(e) Date: Oct. 21, 1985

[87] PCT Pub. No.: WO85/02564

PCT Pub. Date: Jun. 20, 1985

[30] Foreign Application Priority Data

Dec. 6, 1983 [AU] Australia ..... PG2719

[51] Int. Cl.[4] ..... B05C 17/04

[52] U.S. Cl. ..... 15/248 A; 15/44; 15/230.11

[58] Field of Search ..... 15/248 A, 44, 230.11

[56] References Cited

U.S. PATENT DOCUMENTS 3,115,659 12/1963 Church ..... 15/248 A 3,457,582 7/1969 Fisher ..... 15/248 A

*Primary Examiner*—Edward L. Roberts

*Attorney, Agent, or Firm*—Roberts, Spiecens & Cohen

[57] ABSTRACT

The guard consists of an arcuate shaped trough member (6) which has a pad of absorbent material (7) fixed therein. The trough member (6) is mounted in a cradle (8) secured to a support member (9) fixed to a limb (4) of the paint roller assembly by a clamp (10). The arrangement being such that the spatter guard is spaced from but embraces part of the roller and is positioned between the roller and the roller handle.

6 Claims, 2 Drawing Figures

SPATTER GUARD FOR PAINT ROLLERS

FIELD OF THE INVENTION

The invention relates to the construction of a spatter guard for paint rollers.

BACKGROUND OF THE INVENTION

Paint rollers, sometimes called rotary brushes, have become increasingly popular with all classes of users including professional painters. They have the ability to cover large areas in a minimum time with relatively little effort and at the same time produce an extremely good finish.

A paint roller usually comprises a spindle which includes a support arm with a handle fixed thereto. The spindle rotatably supports a cylindrical member in which is fixed an absorbent covering either natural or artificial.

The roller is loaded with paint by rotating it in a tray of paint as is well understood in the art and the paint is then applied to the surface by simply moving the roller over it.

As the roller is rotated, centrifugal force causes small particles of paint to fly from the surface of the roller in all directions. These paint particles spatter the hands and face of the user and also the area beneath the area being painted in most cases where the roller is used for overhead work. The faster the roller is rotated the greater the amount of spattering.

The spattering of paint from rollers is extremely annoying and in an attempt to overcome this problem it has been proposed to use a spatter guard in conjunction with the roller.

There are various types of spatter guards on the market. They usually consist of a trough shaped member secured to the roller handle and extending across the rear of the roller so as to catch particles of paint as it flies from the rear surface of the roller.

These spatter guards have only compounded the problem. While they have proved extremely satisfactory in collecting paint particles, the particles very quickly accumulate into a substantial quantity of paint which necessitates frequent removal and cleaning of the guard which is inconvenient. If this is not done, the accumulated paint simply falls from the guard in the form of large drops.

In consequence, there has been a need for an adequate guard for use with paint rollers which will prevent the spattering from the rear of the roller and which will not leak paint accumulated therein.

SUMMARY OF THE INVENTION

The invention in its broadest form comprises a paint roller spatter guard having an acruate shaped trough member with a pad of absorbent material fixed therein, the trough member being fixed to a cradle secured to a support member fixed by a clamp to the paint roller assembly whereby the spatter guard is spaced from but embraces part of the roller and is positioned between the roller and the roller handle.

BRIEF DESCRIPTION OF THE FIGURES OF THE DRAWING

A preferred embodiment of the invention will now be described with reference to the accompanying drawings in which.

DETAILED DESCRIPTION OF A PREFERRED EMBODIMENT

Figure 1:
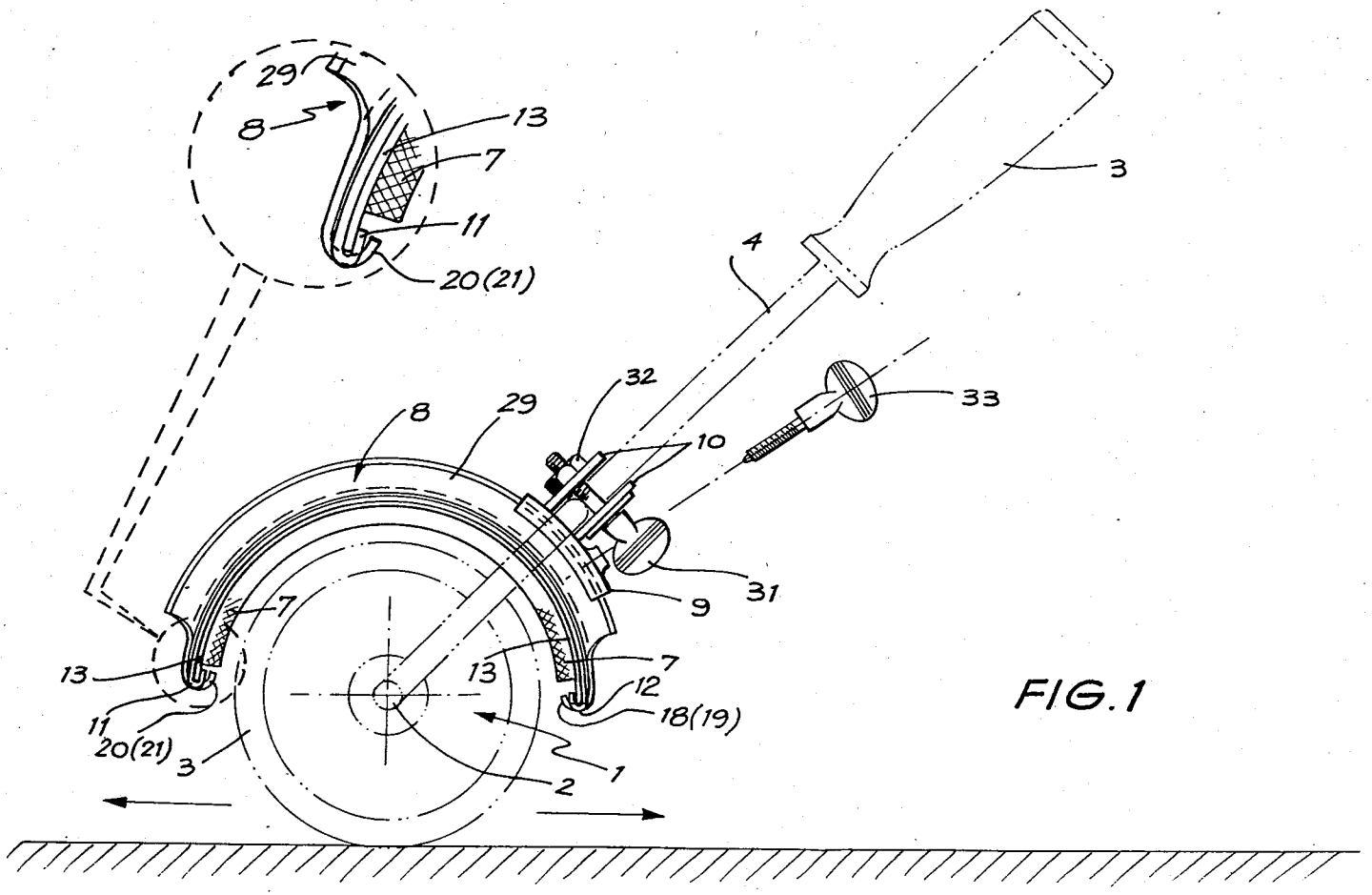
FIG. 1 is an end view of a paint roller embodying the invention.
Figure 2:
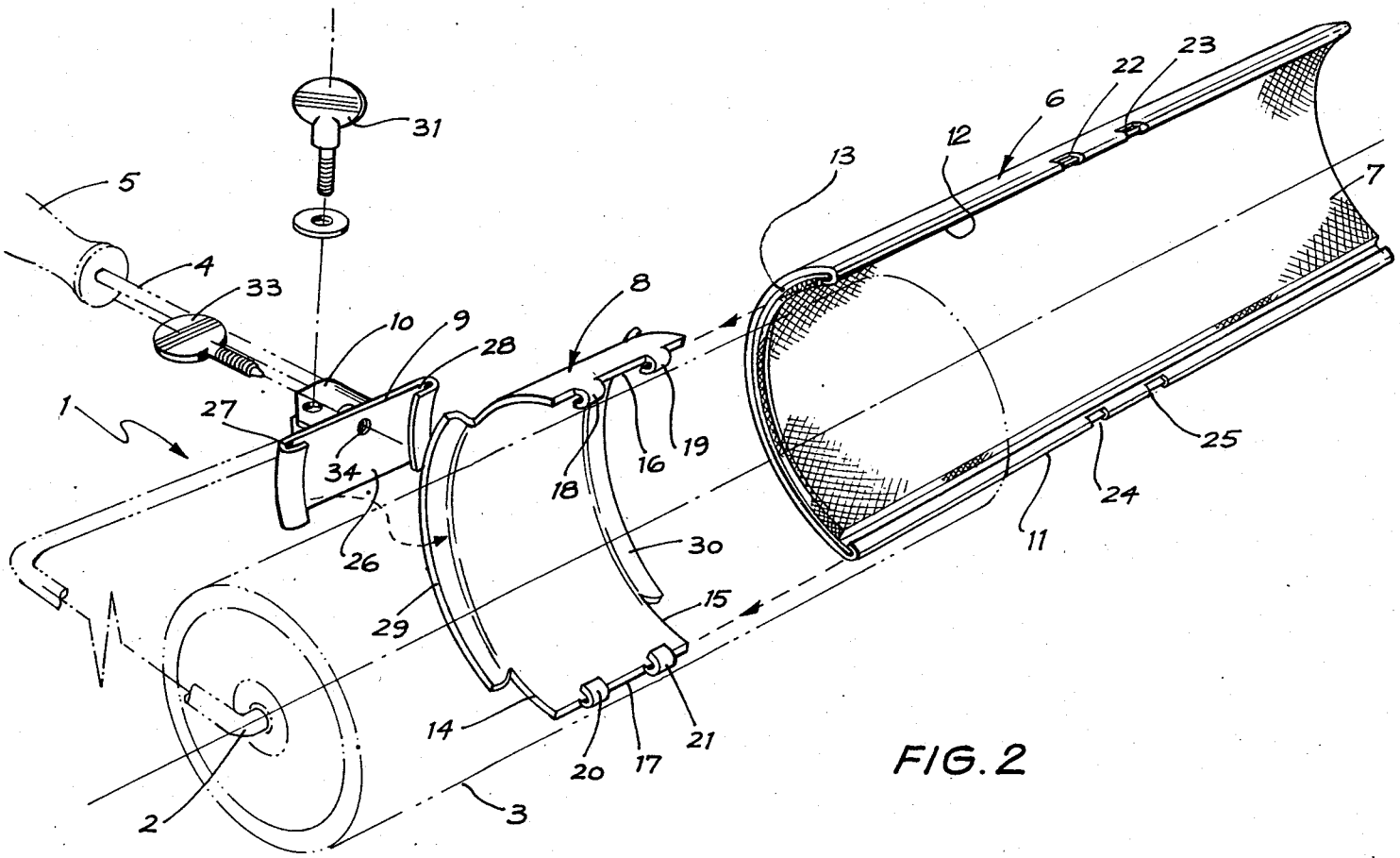
FIG. 2 is an exploded view of the spatter guard with the paint roller shown in phantom outline.

The roller includes a U-shaped arm 1 one limb 2 of which constitutes a spindle which rotatably supports a roller 3. The other limb 4 of the arm is bent at right angles to the axis of the roller and a handle 5 is secured thereto.

A shield or trough member 6 which has a pad of absorbent material 7 fixed therein is supported in a cradle 8 movably supported in a support member 9 fixed to the limb 4 by a clamp 10.

The trough member 6 is arcuate in shape as illustrated and its length corresponds to the length of the roller. The side edges are turned inwardly to define two spaced parallel channels 11 and 12 to receive and support in the trough a flexible backing strip 13 to which the pad of absorbent material 7 is fixed. The manner of attachment of the backing strip to the trough is such that it may simply be removed from the trough member and replaced to facilitate cleaning. As stated, the trough member 6 is supported in the cradle 8. The cradle 8 comprises an acruate shaped member having parallel ends 14 and 15 and parallel side edges 16 and 17. The cradle 8 is of a slightly greater radius than the trough member 6 so as to snugly embrace the trough. It is provided with two hook members 18 and 19 which extend from the edge 16 and two complementary hook members 20 and 21 which extend from the edge 17. The hook members 18 and 19 engage in slots 22 and 23 in the upper edge of the trough member 6 while the hook members 20 and 21 engage in slots 24 and 25 in the lower edge of the trough member 6 thereby positively locking the trough member to the cradle. The support member 9 comprises a plate 26 having inturned ends which with the plate define channels 27 and 28 in which slide flanges 29 and 30 extending from the walls 14 and 15 of the cradle 8. The support member 9 has a clamp 10 secured thereto. The clamp is shaped to fit on the limb 4 and it is retained thereon by a finger bolt 31 which engages a nut 32. The manner of attachment to the limb 4 is such that the whole assembly may be easily and simply removed from the roller. In some instances it may be desirable to alter the angular position of the trough 6 relative to the roller 3. To this end a finger bolt 33 passes through a threaded bore 34 in a plate 26. The end of the bolt presses against the back of the cradle 8 whereby the cradle is locked to the support member 9.

The component parts of the spatter guard except the pad of absorbent material and the backing strip are conveniently made of metal as is well understood in the art. The backing strip is made from flexible plastic sheet material and the absorbent material is preferably an elastomeric material having an interconnected partly closed cell structure. Preferably, the absorbent material is formed of a polyester polyurethane foam material having an interconnected partly closed cell structure with a cell count of 55 to 60 cells per 25 mm.

A pad of this nature will have the following characteristics:

Density (Kg/m$^2$) 31;
Tear resistance (N/m) min 400;
Tensile strength (kPa) min 130;
Elongation (%) min 200; and Cell count (per 25 mm) 50 to 60

What is claimed is:

1. A paint roller spatter guard comprising an arcuate shaped trough member having a pad of absorbent material fixed therein, said trough member being fixed in a cradle secured to a support member fixed by a clamp to a paint roller assembly whereby the spatter guard is spaced from but embraced by part of the roller and is positioned between the roller and the roller handle, said pad of absorbent material being supported on a flexible backing strip, said flexible backing strip having longitudinal edges which engage in channel members on each longitudinal edge of said trough member.

2. A paint roller spatter guard as claimed in claim 1 wherein said absorbent material is an elastomeric material having an interconnected cell structure.

3. A paint roller spatter guard as claimed in claim 2 wherein said elastomeric material is formed of a polyester urethane foam having a cell count of 60±10 cells per 25 mm.

4. A paint roller spatter guard as claimed in claim 3 wherein said polyester urethane foam has the following characteristics:

density ($Kg/m^2$) 31;

tear resistance (N/m) min 400;

tensil strength (kPa) min 130;

elongation (%) min 200; and cell count (per 25 mm) 50 to 60

5. A paint roller spatter guard comprising an arcuate shaped trough member having a pad of absorbent material fixed therein, said trough member being fixed in a cradle secured to a support member fixed by a clamp to the paint roller assembly whereby the spatter guard is spaced from but embraces part of the roller and is positioned between the roller and the roller handle, said cradle comprising an arcuate shaped member of slightly greater radius than said trough member so as to snugly embrace said trough member, said cradle having longitudinal edges with complementary opposed hook members thereon which engages in corresponding slots provided in longitudinal edges of said trough member to secure said trough member to said cradle, said cradle having transverse ends with flanges thereon which engage in spaced channels provided in the support member whereby said trough member is movably secured to said support member and means to lock said trough member in said support member at a selected angular position to said handle.

6. A paint roller spatter guard as claimed in claim 5 wherein the means locking the trough in the support member comprises a hand bolt passing through a threaded bore in said support member, the free end of said bolt locking against the back of said trough.

* * * * *